US011619389B2

(12) United States Patent
Addison

(10) Patent No.: US 11,619,389 B2
(45) Date of Patent: Apr. 4, 2023

(54) MODULAR FIRESTARTER ASSEMBLY

(71) Applicant: John Addison, Atlanta, GA (US)

(72) Inventor: John Addison, Atlanta, GA (US)

(73) Assignee: FIRECLIK IP LLC, Atlanta, GA (US)

( * ) Notice: Subject to any disclaimer, the term of this patent is extended or adjusted under 35 U.S.C. 154(b) by 0 days.

(21) Appl. No.: 17/675,849

(22) Filed: Feb. 18, 2022

(65) Prior Publication Data

US 2022/0333784 A1 Oct. 20, 2022

Related U.S. Application Data

(60) Provisional application No. 63/174,898, filed on Apr. 14, 2021.

(51) Int. Cl.

| | |
|---|---|
| ***F24B 1/195*** | (2006.01) |
| ***C10L 11/04*** | (2006.01) |
| ***C10L 11/08*** | (2006.01) |

(52) U.S. Cl.

CPC ..... *F24B 1/195* (2013.01); *C10L 11/04* (2013.01); *C10L 11/08* (2013.01); *C10L 2230/06* (2013.01); *C10L 2230/20* (2013.01)

(58) Field of Classification Search

CPC ..... C10L 11/04; C10L 11/08; C10L 2230/06; C10L 2230/20; F24B 1/195

See application file for complete search history.

(56) References Cited

U.S. PATENT DOCUMENTS 8,365,907 B1 * 2/2013 Mooney ..... A45F 3/18 206/217
2019/0315510 A1 * 10/2019 Kozolup ..... C10L 11/06

FOREIGN PATENT DOCUMENTS

IL 224794 A1 * 8/2014
WO WO-03080770 A1 * 10/2003 ..... C10L 11/06
WO WO-2017165905 A1 * 10/2017 ..... C10L 11/04

* cited by examiner

*Primary Examiner* — Latosha Hines
(74) *Attorney, Agent, or Firm* — Smith Gambrell & Russell LLP

(57) ABSTRACT

A modular firestarter assembly. The modular firestarter assembly includes a number of modular components configured to be able to mount to one another to form the firestarter assembly. The modular components can be broken down to save side. The modular firestarter assembly can be formed from a number of different combinations of the modular components to hold fuel sources and assist in starting a fire.

20 Claims, 8 Drawing Sheets

MODULAR FIRESTARTER ASSEMBLY

CROSS REFERENCE TO RELATED APPLICATIONS

This application claims benefit of and priority to U.S. Provisional Patent Application No. 63/174,898 filed on Apr. 14, 2021, and which is incorporated by reference in its entirety.

FIELD OF INVENTION

This invention generally relates to firestarters.

BACKGROND OF THE INVENTION

The need for aid in starting fires is long felt as many individuals utilize firestarters. An efficient firestarter is one that uses the least amount of material possible to achieve the primary goal of all firestarters, which is to ignite external natural fuel sources such as twigs, limbs and logs for a sustained fire. While firestarters of the prior art achieve this primary goal successfully, they are relatively inefficient and limited for individuals looking for a lighter, more packable, more customizable, and yet equally effective solution.

One of the main limitations of common firestarters is their basic structural shape. The majority of these firestarters are similar in shape regardless of material composition—a shape that resembles a dense solid block, briquette, or rope of extruded or molded material whether organic or chemically derived. These densely solid firestarters require more material than necessary in most occasions and result in a relatively heavier product that can be cumbersome to pack or stow. Their solid shape also requires more effort from the user to structure or build up externally sourced kindling for a sustained fire, requiring more skill and effort from novice fire builders.

Few current firestarters have an advanced shape or structural design outside of the basic solid block variations described above. These conventional and basic structural designs are unable to improve material efficiency by harnessing natural fire growth tendencies such as breathability, height, and surface area exposure of natural fuel sources. They are also structurally limited from offering further improved features of an advanced design such as the ability to act as a template or guide for the user in the organization of natural fuel sources, superior packability when not in use, and customizability based off weather conditions and skill level.

With the rise of ultralight camping sports where every ounce and packability matters, there is relevance and need for a significantly lighter, more packable, and more efficient firestarter that is equally effective while remaining equally affordable to current solutions. There is also need for a firestarter that acts as a template or guide for the user that effectively aids in the organization and structuring of natural fuel sources for a sustained fire, particularly for users that are less skilled in the art of fire making.

Further, these one size fits all firestarters prevents efficient use of such materials, especially for those who are more experienced at starting fires, and largely do not take into consideration the conditions in which the fire is being started (e.g., dry conditions with no wind v. wet conditions v. windy conditions).

Therefore, there is a need for a more efficient firestarter that uses less material while implementing an advanced design that provides the user with more efficiency, customizability and functionality for starting a fire.

SUMMARY OF THE INVENTION

The present disclosure relates to an apparatus to be used as a firestarter. The firestarter may be modular in nature according to an aspect of the present invention. The firestarter can be configured to hold a plurality of natural fuel sources. In an aspect, the firestarter can be a fuel source itself. In an aspect, the firestarter can include several independent and separate modular components that allow for a plurality of configurations for the firestarter when in use. The components contain at least three sides with a plurality of apertures configured to hold fuel sources. The components have been configured to contain coupling means to connect at least two modular components at the side. The coupling means allow for the separate modular components to facilitate embodiments of the firestarter assembly that can construct a variety of three-dimensional shapes, including polyhedrons. The firestarter assembly improves ease of starting fires through various means including the optimization of air flow, fire height, and the like.

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

The accompanying drawings are included to provide a further understanding of the invention and are incorporated in and constitute part of this specification, as well as illustrate several embodiments of the invention that together with the description serve to explain the principles of the invention.

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the following description, numerous specific details are set forth. However, it is to be understood that embodiments of the invention may be practiced without these specific details. In other instances, well-known methods, structures, and techniques have been shown in detail in order not to obscure an understanding of this description.

In order to achieve the primary goal of all firestarters with less material and therefore weight while increasing firestarter size, shape, and volume (and therefore potential flame output) the present invention is a firestarter with superior structural and geometrical shape that is designed off of 4 major considerations: 1) the natural characteristics and tendencies of fire 2) the abundance of natural fuel sources found in many backyards, camping areas, and primitive wilderness settings 3) the need for an ultralight and packable solution that can flatly lay in the palm of one's hand or fit flatly in one's pocket or backpack and 4) the need for a solution that can be assembled in multiple configurations of increasing effectiveness based off of weather conditions and individual skill level.

Figure 1A:
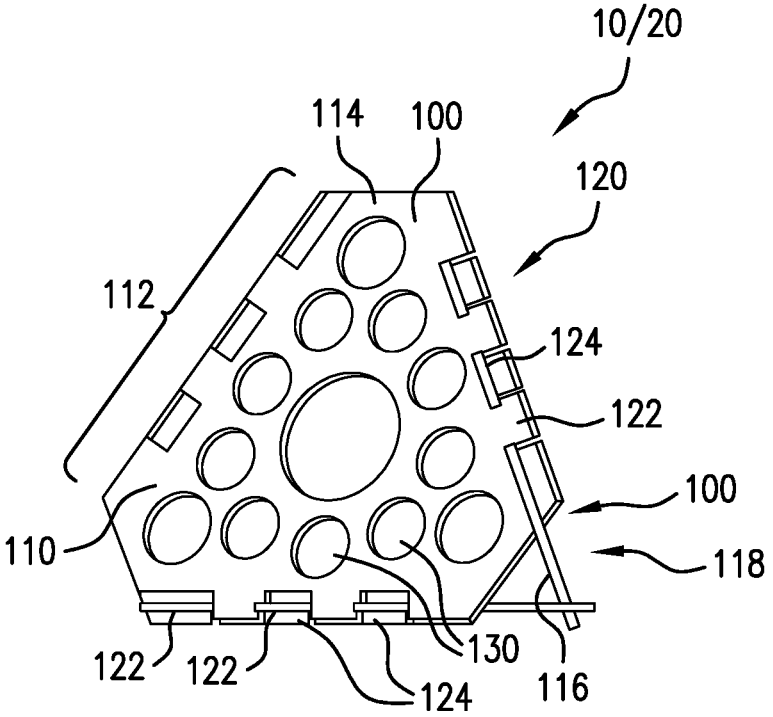
FIGS. 1A-1E show multiple side plan views (FIGS. 1A-1C), a top plan view (FIG. 1D), and a bottom plan view (FIG. 1E) of a firestarter according to an aspect of the present invention, FIG. 2 displays a modular component 100 according to an aspect of the present invention.
Figure 1B:
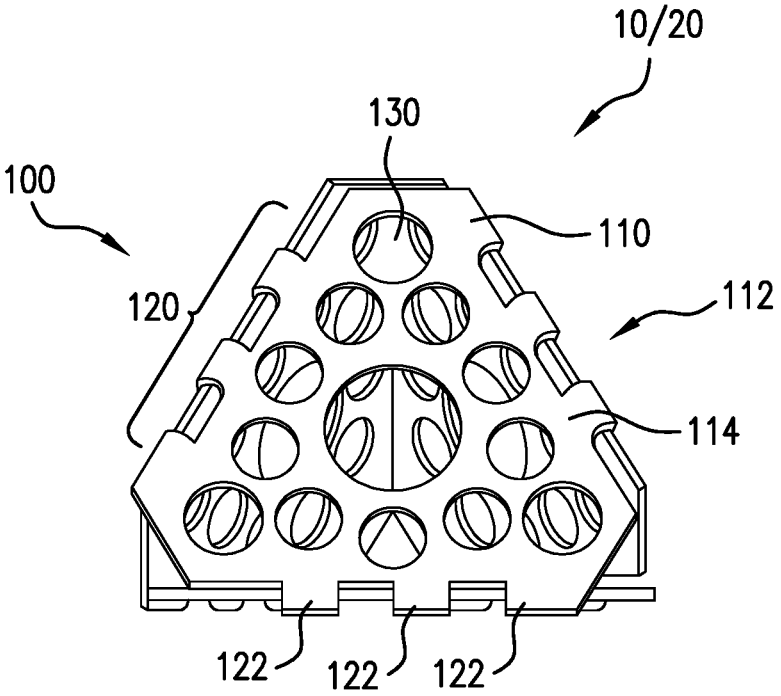
Figure 1C:
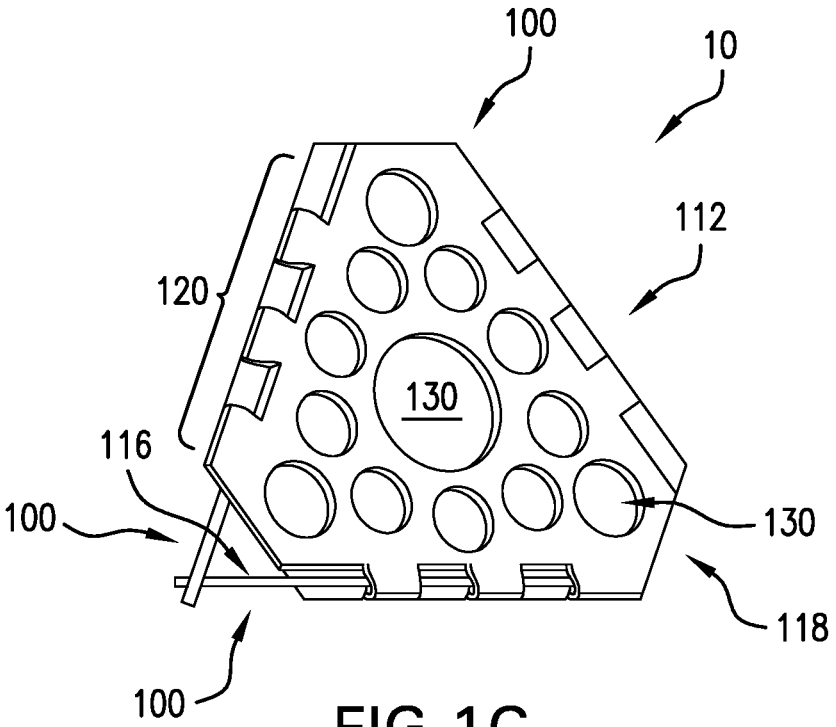
Figure 1D:
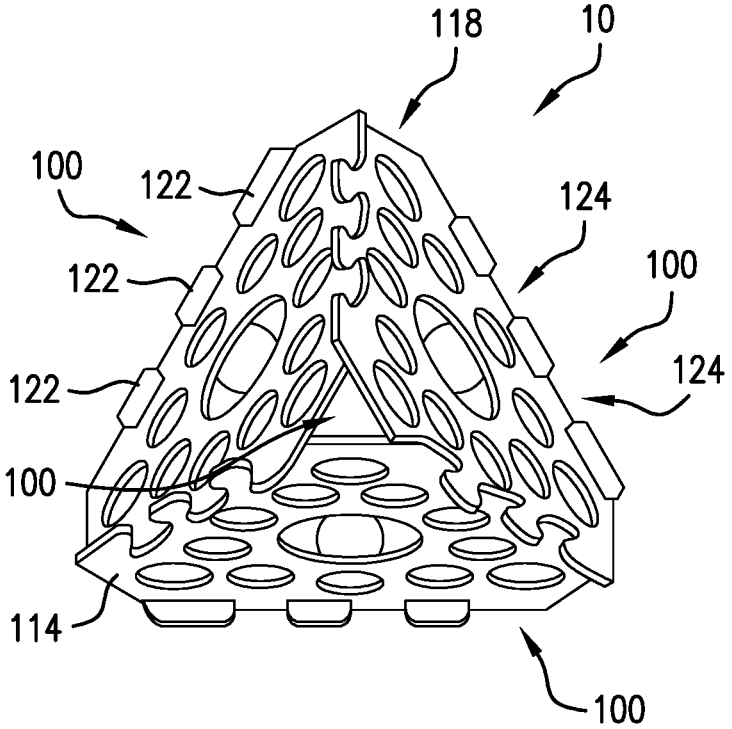
Figure 1E:
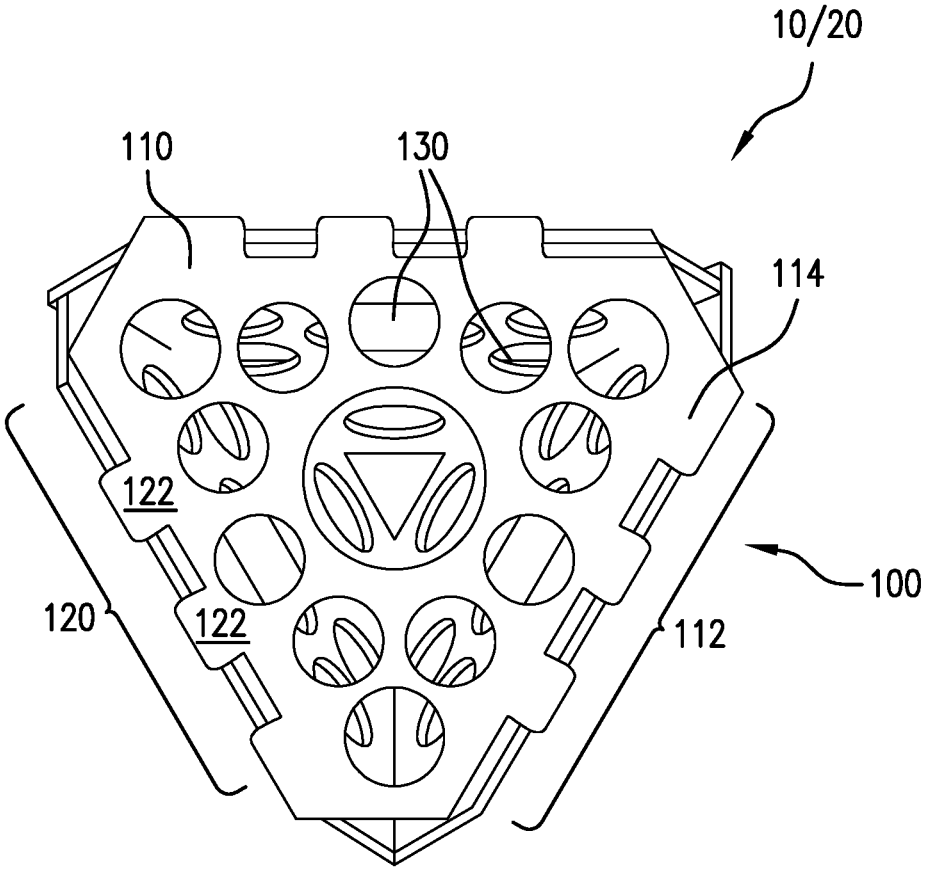
Figure 2:
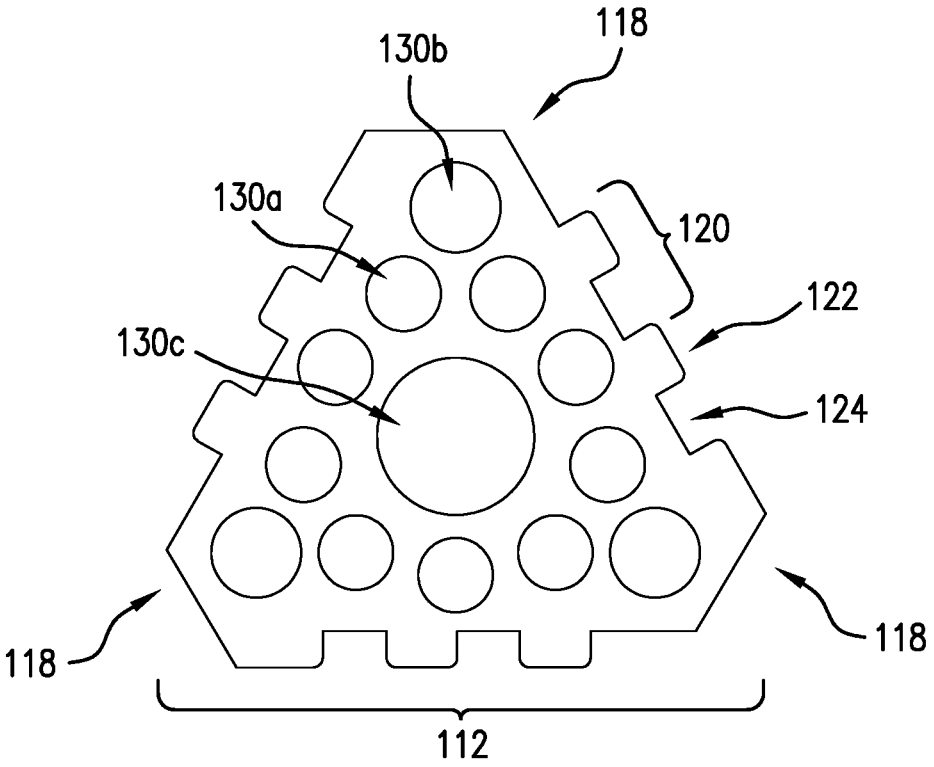

In an aspect, the invention is directed towards a firestarter assembly 10 as shown in FIGS. 1-6. As shown, the firestarter assembly 10 is configured to hold other fuel sources 50 for a fire. While it is desirable for the fuel source to be natural, the firestarter assembly 10 can utilize other fuel sources 50, such as natural materials (e.g., twigs, branches, etc.) or chemical materials potentially subject to processing. In an aspect, the firestarter assembly 10 includes a modular component 100, as shown in FIG. 2. In some aspects, the firestarter assembly 10 includes multiple modular components 100, with each modular component 100 being separate from one another until joined together through detachable coupling means.

Each of the modular components 100 includes a body 110, with the coupling means configured to join the bodies 110 of the modular components 100 to build the firestarter assembly 10, as discussed below. In an aspect, the body 110 can be made of a fire conducive material, or is treated to be fire conducive. For example, the material of the body 110 can include, but is not limited to, paperboard, chipboard, wood, wood or plant fibers, cloth, solid chemical fuels, and the like. In an aspect, the paperboard can be non-corrugated and thick. In an aspect, the use of non-corrugated material allows for ease of assembly of the separate modular components 100 together to form the firestarter assembly 10, via durable joints (discussed below) while presenting a solid, rigid, and flexible material that burns well. In an aspect, the use of thick paperboard offers a rigid, flexible and burnable raw material that can be easily die cut into desirable shapes to form the separate and individual modular components 100 of the firestarter assembly 10 as discussed below. In an aspect, the material of the body can be treated, or left untreated. Such treatment can include coating the material. The coating can include wax, oils, or other compounds that increase combustibility or to provide water resistance and prolonged burn time. In an aspect, the material used to form the body 110 of the modular component 100 of the firestarter assembly 10 is treated after the modular component 100 is formed. In other aspects, the material can be treated before the modular components 100 are formed. However, treating body 110 of the modular component 100 after it is formed can ensure that all of the surfaces are treated, as well as reduce waste of the treatment on removed material.

In an aspect, the body of 110 of the modular component 100 can be made of non-combustible material. In an aspect, the non-combustible material can be chosen from metal, fiberglass, heat-resistant polymers, and the like. The use of a non-combustible material facilitates a re-usable embodiment of the firestarter assembly 10. Such a reusable firestarter assembly 10 aids fire starting for users of various expertise levels by aiding in the structure of the fire. Fuel sources 50 may be placed in the non-combustible components 100 in a manner that increases early fire growth by enhancing air flow, height, and other characteristics necessary to create fire.

In other aspects, the firestarter assembly 10 may utilize a combination of combustible modular components 100 and non-combustible, reusable modular components 100, discussed in more detail below.

Figure 3:
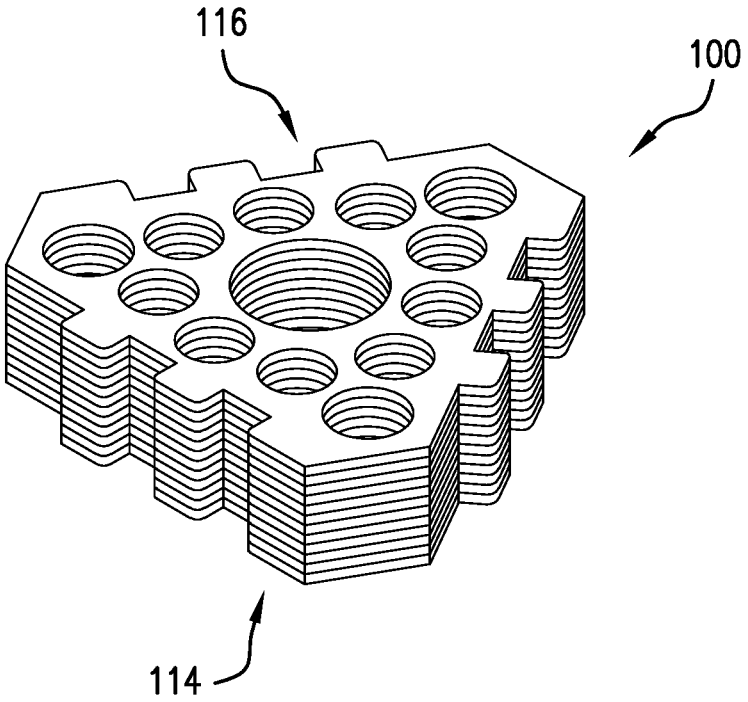
FIG. 3 is a top plan view of multiple modular components of the firestarter of FIGS. 1A-1E.

In an aspect, as shown in FIG. 2, the body 110 of the modular components 100 is a polygon, having at least three sides/edges 112. In addition, the body 110 includes a front surface 114 and a back surface 116 as shown in FIG. 3. While separate and independent from one another, each modular component 100 is configured to be joined with other modular components 100 to form a polyhedron 20, as shown in FIGS. 1A-1E. In some aspects, all sides 112 of each modular component 100 can be joined to sides 112 of other modular components 100 through coupling means 120, discussed below. In some aspects, the edges 112, absent the coupling means 120, of the bodies 110 of the modular components 100 are substantially straight, and are substantially the same length. In such instances, having separate modular components 100 with bodies 110 of the same dimensions allows for easy of manufacture, storage (see FIGS. 3 and 4), and configuration (i.e., assembly). Further, in some of these instances, corners 118 of the bodies 110 can have a rounded shape, allowing for easier assembly, and additional benefits discussed below. In other aspects, the bodies 110 of the modular components 100 can have various shapes amongst themselves.

For example, as shown in in FIG. 2, the body 110 is a triangle. In some exemplary aspects, the triangle has three sides 112 of the same length, forming an equilateral triangle. Other embodiments may have different lengths amongst their sides 112. Having uniform side lengths, however, allows for uniform modular components 100 which assists in assembly and manufacturing. Uniform modular components allows for a uniform polyhedron 20, which can make assembly easy, as well as use with fuel sources 50. With uniform modular and separate components 100, the orientation of each modular component 100 is not important, as there is no distinguishable top or bottom, allowing multiple alignments, increasing the ease of assembly. For example, when four equilateral triangular modular components 100 are joined together, as shown in FIGS. 1A-1E, they form a pyramid polyhedron 20. In other aspects, the body 110 of the modular component 100 can be formed from other polygon shapes which lead to other polyhedrons being formed when all edges 112 are connected. For example, squares, pentagons, hexagons, and the like can be used to form cubes, pentahedron, hexahedron, and the like.

As discussed above, each modular component 100 includes coupling means 120 that allows each side 112 to be joined to another side 112 of another modular component 100. In an aspect, the coupling means 120 can include a joint system 120, as shown in FIG. 2. The joint system 120 can be shared amongst sides 112 of the modular components 110. For example, the joint system 120 can be made of multiple male joints 122 along sides 112 that form female joints 124. The male joints 122 of a first modular component 110 are configured to be received by female joints 124 of a second modular component 110, and the male joints 122 of the second modular component 110 are configured to be received by the female joints 124 of the first modular component 110, as shown in FIGS. 1A-1E. As shown in FIG. 2, each side can be configured to have two male joints 122 and two female joints 124, though in other embodiments, various other combinations, in number and in types of joints, can be utilized. This joint system 120 allows for the separate modular components 100 to be connected and disconnected in various alignments and configurations with one another.

In other aspects, various numbers of male joints 122 and female joints 124 can be utilized, and in different combinations. For example, if the body 110 has a square shape, it is possible that one pair of opposite sides 112 includes two male joints 122 and one female joint 124, and the other pair of opposite sides 112 includes one male joint 122 and two female joints 124. In odd number sides, the same distribution of male/female joints can be used.

Further, in other aspects, other coupling means can be utilized. For example, tongue and groove coupling means, tab/insert means, and various other configurations can be utilized. However, the male/female joint does provide an ease of assembly and manufacturing. Regardless, the coupling means should still allow joining of the modular components 110 over a range of degrees, including at least an approximate 90° angle as well as other angles conducive to constructing three-dimensional structures.

As shown in FIG. 1A-1E, 2, and 5A-D, each modular component 100 includes a number of apertures 130 within the body 110. As discussed above, the apertures 130 are configured to hold, organize and structure additional fuel sources 50 in an optimized fashion conducive to early fire growth. The fuel sources 50 can include natural fuel sources 50 such as twigs and other wood-based products traditionally used in fires. In an aspect, the apertures 130 can be of various sizes. As shown in FIG. 2, the apertures 130 include small apertures 130*a*, medium apertures 130*b*, and large apertures 130*c*. The various sizes allow for the fire assembly 10 to hold fuel of various sizes. In addition to holding fuel sources 50, the apertures 130 increase the amount of air that any initial fire is exposed to, which can increase the efficiency and heat of the fire that is started, ensuring a better burn.

In addition, the various apertures 130 are found throughout the body 110 of the modular component of the fire assembly 10. When the fire assembly 10 is assembled (discussed below), the apertures 130 of one modular component 100 can be utilized with corresponding apertures 130 of other modular components 100 to retain fuel sources 50. When at least two modular components 100 are used to form the fire assembly 10, fuel sources 50 can be fed into apertures 130 of different modular components 100, which can raise the fuel source off of the ground, adding in the building of the fire. In addition, those fuel sources 50 inserted into apertures 130 found higher along the modular components 100 (i.e., apertures 130 found near sides 112 opposite a side 112 placed on the surface/ground) will be preheated before catching fire. This increases the chances of a steady flame being produced. In an aspect, the plurality of apertures 130 are oriented across modular components 110 in a similar fashion. In other words, apertures 130 are located at the same positions on each modular component 110.

As discussed above, the firestarter assembly 10 can be made of various combinations of modular components 100 when used to start a fire. For example, when the body 110 of the modular component 100 has a triangular shape, a user can use one, two, three, or four modular components 100 to use the firestarter assembly 10, as discussed below. The number of modular components 100 used can be dependent on the experience of the user and the conditions in which the fire is attempted to be made.

Figure 5A:
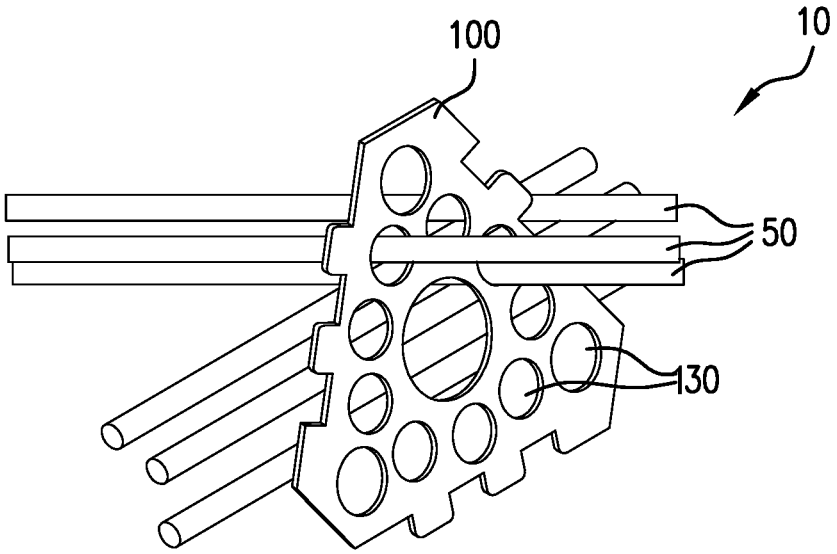
FIGS. 5A-5D display various configurations of modular components (one (FIG. 5A), two (FIG. 5B), three (FIG. 5C), or four (FIG. 5D)) of the firestarter of FIGS. 1A-1E holding fuel sources according to an aspect of the present invention.
Figure 5B:
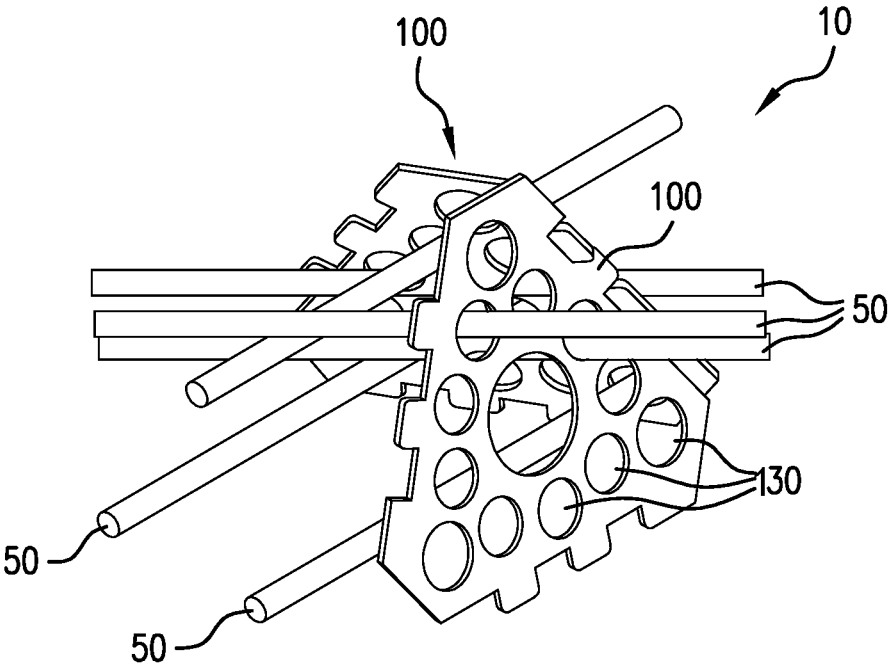
Figure 5C:
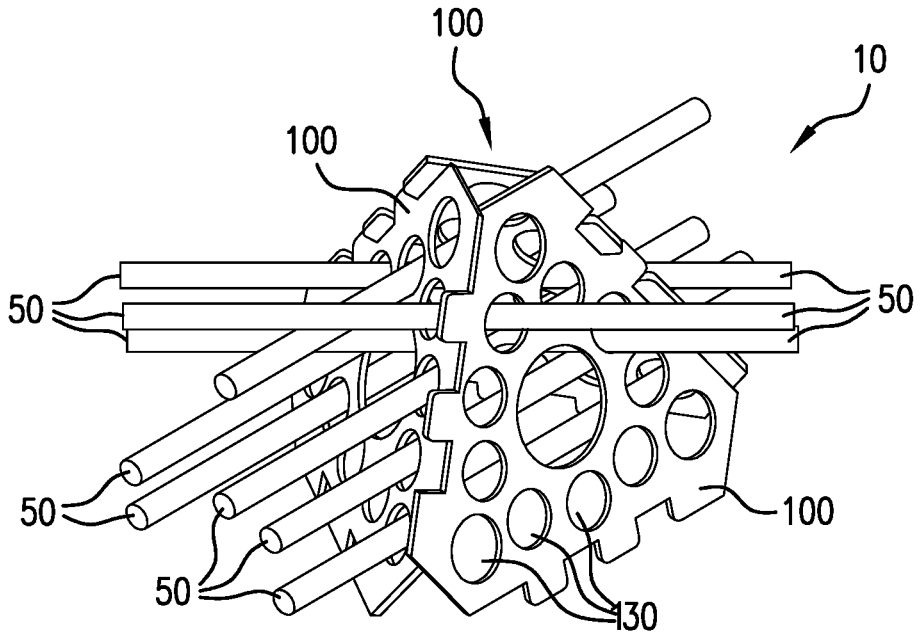
Figure 5D:
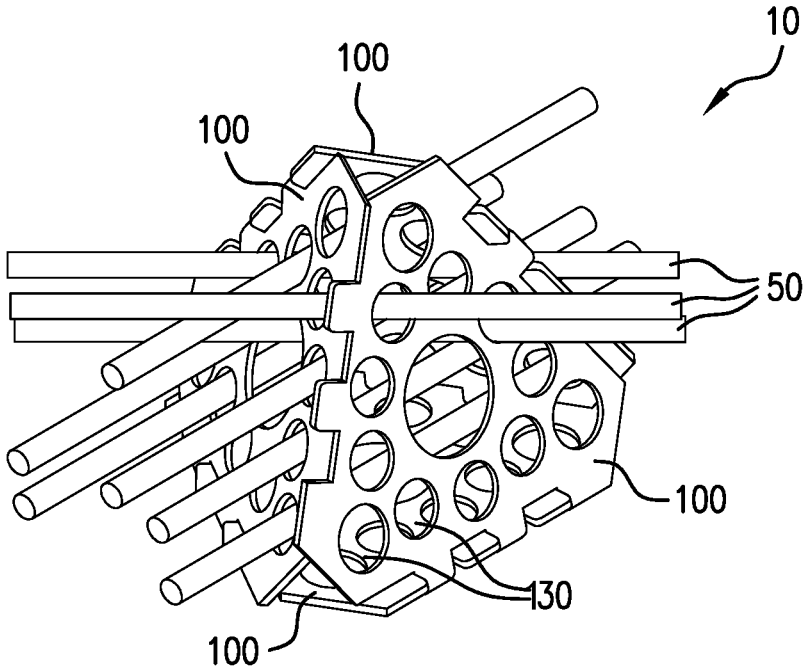
Figure 6:
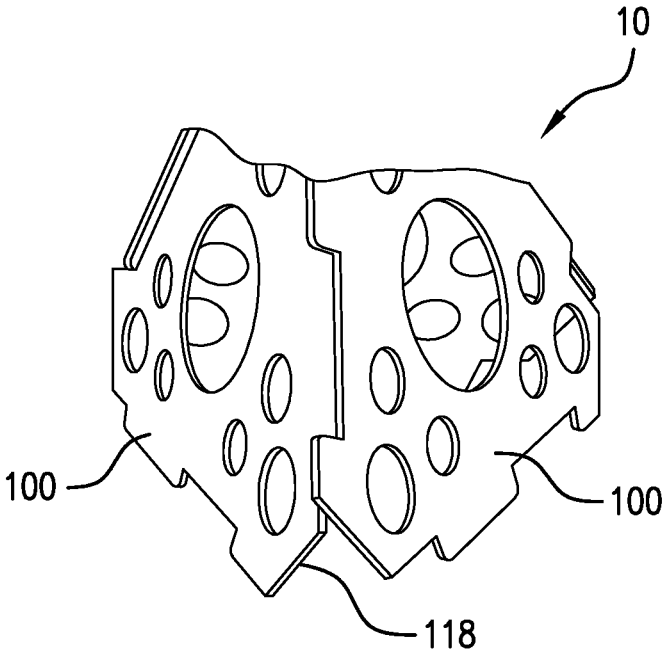
FIG. 6 illustrates a location at which to ignite the firestarter according to an aspect of the present invention

For example, if conditions are bad for fire (wet and windy, fuel sources are wet as well), three or four modular components 100 can be joined together to form a 4 sided pyramid 20, as shown in FIG. 5D. To do so, the user would join each side 112 of the four modular components 100 to one another by inserting the male joints 122 into the female joints 124, with one of the four modular components 100 forming a base. The remaining three components 100 are oriented in a mostly vertical position, and then can have fuel sources 50 inserted into their respected apertures 130. In an aspect, the fire assembly 10 is assembled such that each fuel source used can be inserted into two apertures on different modular components 100, and preferably apertures 130 that are found on the same level so to keep the fuel source substantially parallel to the bottom modular component 100. As the fuel sources 50 are inserted in such a fashion, the fuel sources 50 are found in a rising, crisscrossing fashion that exposes the most surface area possible to the budding flame.

In another aspect, three modular components 100 can be utilized to form a bottomless pyramid assembly 20 (FIG. 5C), similar to the pyramid discussed above. Fuel sources 50 can be inserted in the same manner as discussed above as well. Once the apertures 130 are filled, a user can use another fire starting source, such as a match, lighter, flint stick, etc., to light one of the modular components 112, preferably at corners 118 (see FIG. 6).

In either case (pyramid with three or four modular components 100), the pyramid structure firestarter assembly 10 provides many advantages, especially for inexperienced fire starters. First, the apertures 130 of the modular components 100 act as a template/guide for arranging fuel sources 50. Most individuals do not know how to properly space, stack and organize kindling to create a strong base for a fire. The firestarter assembly 10 guides them in that process and allows them to do so in an optimized and efficient fashion. Further, the pyramid 10 provides optimized height and volume at minimal mass, both critical for assisting in building a fire. The height of the pyramid 10 provides a place for the fire to climb, as budding fire naturally likes to climbs vertically. The apex of the pyramid 10 also allows flames found on each separate but joined together modular component 100 and fuel sources 50 to converge and maximize heat at that point. The base of the pyramid 10 provides a base for lighting. The triangular base allows for 3 prominent places to light with a match or lighter. These prominent lighting areas are low in height and give the flame plenty of height to grow and climb up the pyramid as it naturally likes to do so. Further, the volume of the pyramid firestarter assembly 10 allows for more external fuel sources 50 to be inserted via the apertures 130.

In addition, less than three modular components 100 can be utilized to start a fire. For example, if the user is well experienced in starting fires, or the conditions are very favorable to start a fire (e.g., very dry fuel sources 50 and ground and no wind), a singular or two modular component(s) 100 can be utilized as seen in FIGS. 5A and 5B. A user can put fuel sources 50 within the apertures 130 of the modular component 100, with a portion of the fuel sources 50 resting on the ground to hold up the modular component(s) 100. This can be done if an individual is low on modular components 100.

Figure 4:
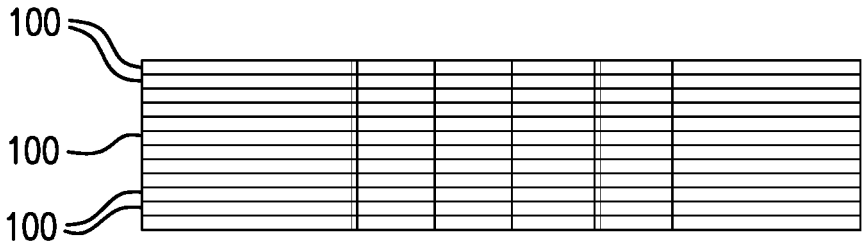
FIG. 4 is a side plan view of multiple modular components of FIG. 3 stacked on one another according to an aspect of the present invention.

Last, the individual modular components 100 can be easily stored to take up less room when not being set up and used to start a fire, as shown in FIGS. 3-4. That is, an unassembled grouping of separate modular components 100 can be stacked together, taking up much less space than when assembled. The volume occupied can also be reduced if the modular components 100 are uniform. In addition, by rounding the corners 118, and having apertures, and making it collapsible, the unassembled firestarter assembly 10 weighs much less than other fire starters. In an aspect, the modular components 100 are also relatively light weight, offering advantages for outdoor activities. In an aspect, modular components 100 weigh approximately 1.4 grams each, though other weights could also be manufactured. In an aspect, outdoor activities consist of activities where lightweight options are advantageous, such as camping, hiking, and the like.

Having thus described exemplary embodiments of the present invention, it should be noted by those skilled in the art that the disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A firestarter assembly comprising;
   a. a modular component comprising:
      i. a body;
      ii. a plurality of apertures configured to hold fuel sources, the plurality of apertures in the body;
      iii. three sides of the body; and
      iv. coupling means configured to removably connect one of the sides of the body to another side of a body of another modular component, wherein the modular component and the another modular component are separate from one another until connected.

2. The firestarter assembly of claim 1, wherein the body of the modular component comprises a fire conducive material, or a material that is treated to be fire conducive.

3. The firestarter assembly of claim 1, wherein the body of the modular component comprises a non-combustible material.

4. The firestarter assembly of claim 1, wherein the coupling means comprises a joint, the joint comprising:
   i. at least one male joint; and
   ii. at least one female joint, wherein the at least one male joint and the at least one female joint are oriented in the same fashion along each side and are configured to engage with other corresponding female and male joints of other modular components.

5. The firestarter assembly of claim 1, wherein the modular component comprises a first modular component and the another modular component is a second modular component, wherein a first side of the body of the first modular component is configured to engage a first side of the body of the second modular component.

6. The firestarter assembly of claim 5, wherein fuel sources are inserted into a portion of the plurality of apertures in order to elevate the fuel sources within the assembly and off of the ground or another separate surface on which the assembly rests.

7. The firestarter assembly of claim 5, further comprising a third modular component, wherein a first side of the body of the third component is configured to engage with the second side of the body of the first modular component and the second side of the body of the third component is configured to engage with a second side of the body of the second modular component.

8. The firestarter assembly of claim 7, wherein the modular components are equilateral triangles and form an equilateral pyramid when joined together.

9. The firestarter assembly of claim 7, further comprising a fourth modular component, wherein a first side of the body of the fourth modular component is configured to engage with a third side of the body of the first modular component, and a second side of the body of the fourth modular component is configured to engage a third side of the body of the second modular component.

10. The firestarter assembly of claim 9, wherein the body of the fourth modular component further comprises a third side configured to engage a third side of the body of the third modular component.

11. The firestarter assembly of claim 1, wherein the plurality of apertures comprises a first portion of apertures of one size and a second portion of apertures of a second side.

12. The firestarter assembly of claim 11, wherein each modular component is an equilateral polyhedron and the first portion and the second portion of apertures are arranged along each modular component in substantially similar locations so that when the modular components are engaged with one another the first portion and the second portion of apertures are aligned with the same.

13. The firestarter assembly of claim 1, wherein the modular component comprises a plurality of modular components, wherein the modular components are configured to stack flat on one another when disassembled from one another.

14. The firestarter assembly of claim 1, wherein the modular component comprises tapered corners to allow for ease of ignition.

15. A method of using a firestarter assembly, wherein the firestarter assembly comprises one or more modular components, to start a fire comprising:
   a. setting up the one or more modular components;
   b. inserting fuel sources into the apertures of the modular component(s); and
   c. combusting the fuel sources with a fire starting source, wherein the one or more modular components each comprise a body, and wherein the bodies of the one or modular components are separate and independent from one another.

16. The method of claim 15, wherein the one or more modular components has no more than two modular components.

17. The method of claim 15, wherein the one or more modular components comprises more than two modular components.

18. The method of claim 17, wherein the setting up the more than two modular components comprises coupling the more than two modular components to each another.

19. The method of claim 18, wherein the body of the modular components comprise:
   i. a plurality of apertures configured to hold fuel sources;
   ii. at least three sides; and
   iii. coupling means used to connect one of the at least three sides of the body of the modular component to one of at least three sides of the body of another modular component.

20. The method of claim 19, wherein the coupling means comprises a joint comprising:

i. at least one male joint; and ii. at least one female joint, wherein the at least on male joint and the at least one female joint are oriented in the same fashion along each side and are configured to engage with other corresponding female and male joints of other modular components.

* * * * *